US006202792B1

(12) United States Patent
Cheong et al.

(10) Patent No.: US 6,202,792 B1
(45) Date of Patent: Mar. 20, 2001

(54) APPARATUS FOR LUBRICATING EDGE DAM IN TWIN-ROLL TYPE STRIP CASTING MACHINE, AND METHOD THEREFOR

(75) Inventors: Han Nam Cheong; Dong Kyun Choo; Tae Wook Kang, all of Kyungsangbook-do (KR)

(73) Assignees: Pohang Iron & Steel Co., Ltd.; Research Institute of Industrial Science & Technology, both of (KR)

( * ) Notice: Subject to any disclaimer, the term of this patent is extended or adjusted under 35 U.S.C. 154(b) by 0 days.

(21) Appl. No.: 09/367,728

(22) PCT Filed: Dec. 16, 1998

(86) PCT No.: PCT/KR98/00432

§ 371 Date: Aug. 19, 1999

§ 102(e) Date: Aug. 19, 1999

(87) PCT Pub. No.: WO99/32246

PCT Pub. Date: Jul. 1, 1999

(30) Foreign Application Priority Data

Dec. 20, 1997 (KR) ..... 97-71229

(51) Int. Cl.[7] ..... B22D 11/06

(52) U.S. Cl. ..... 184/101; 184/17; 184/23; 164/149; 164/268; 164/428; 164/472; 164/480

(58) Field of Search ..... 184/17, 23, 101; 164/149, 268, 428, 472, 480

(56) References Cited

U.S. PATENT DOCUMENTS

| | | | | |
|---|---|---|---|---|
| 477,422 | * | 6/1892 | Kellom | 184/17 |
| 2,909,150 | * | 10/1959 | Ungerer | 184/17 |
| 4,033,289 | * | 7/1977 | Taylor et al. | 184/101 |
| 4,638,761 | * | 1/1987 | Carrick | 184/17 |
| 4,754,802 | * | 7/1988 | Yamauchi et al. | 164/428 |
| 5,027,888 | * | 7/1991 | Sakaguchi et al. | 164/480 |
| 5,058,658 | * | 10/1991 | Veyret | 164/428 |
| 5,188,166 | * | 2/1993 | Perry | 164/416 |
| 5,201,362 | | 4/1993 | Yamagami et al. | 164/480 |
| 5,368,128 | * | 11/1994 | Waldchen | 184/17 |
| 5,476,546 | * | 12/1995 | Zibulla | 184/17 |
| 5,628,359 | * | 5/1997 | Legrand et al. | 164/428 |

FOREIGN PATENT DOCUMENTS

| | | | | |
|---|---|---|---|---|
| 369999 | * | 2/1923 | (DE) | 184/17 |
| 0677345 | | 3/1995 | (EP) . | |
| 6-015416 | | 1/1994 | (JP) . | |
| 7-068352 | | 3/1995 | (JP) . | |
| 9-108788 | | 4/1997 | (JP) . | |
| 9-248658 | | 9/1997 | (JP) . | |

* cited by examiner

*Primary Examiner*—David A. Bucci
*Assistant Examiner*—Chong H. Kim
(74) *Attorney, Agent, or Firm*—Webb Ziesenheim Logsdon Orkin & Hanson, P.C.

(57) ABSTRACT

An apparatus and a method for lubricating an edge dam in a twin-roll type strip casting machine are disclosed. A continuous uniform lubrication boundary layer is formed on the friction face between the casting rolls and the edge dam, so that the wear of the edge dam refractory material can be reduced, and that the friction faces of the casting roll can be protected, thereby improving the performance and the durability of the machine. The apparatus includes a lubricant spouting nozzle disposed adjacently to a friction face of the casting roll, and a lubricant supplying device for supplying a lubricant to the lubricant spouting nozzle so as to make the lubricant spouted and adhered on the friction face of the casting roll. Further a lubricant spreading roller is installed at a rear of the lubricant spouting nozzle, for pressing the lubricant onto the friction face of the casting roll with a certain pressure so as to make the lubricant clad on the friction face. The method includes the following steps. A liquid lubricant is spread onto the friction face of the casting roll, and the lubricant is made to be uniformly spread on the friction face with the required width. Thus lubricating layer is formed continuously on the friction face, in a state with a solvent of the liquid lubricant being evaporated.

9 Claims, 8 Drawing Sheets

APPARATUS FOR LUBRICATING EDGE DAM IN TWIN-ROLL TYPE STRIP CASTING MACHINE, AND METHOD THEREFOR

BACKGROUND OF THE INVENTION

1. Field of the Invention

The present invention relates to an apparatus and a method for lubricating an edge dam in a twin-roll type strip casting machine, in which strips are continuously manufactured by supplying a metal melt into between a pair of casting rolls. More specifically, the present invention relates to an apparatus and a method for lubricating an edge dam in a twin-roll type strip casting machine, in which a continuous uniform lubrication boundary layer is formed on the friction face between the casting rolls and the edge dam, so that the wear of the edge dam refractory material can be reduced, and that the friction faces of the casting roll can be protected, thereby improving the performance and the durability of the machine.

2. Description of the Prior Art

Generally, as shown in FIG. 1, a twin-roll type strip casting machine 100 supplies a melt 122 from a tundish 110 through a melt supply nozzle 112 into between a pair of revolving casting rolls 120, thereby directly manufacturing metal strips 130 of several mm.

Further, the casting rolls 120 are disposed in parallel with each other, and at both sides of the casting rolls, there are installed refractory plates called "edge dam 140". During the casting of the strips, the edge dams 140 prevent the spilling of the melt 122 from the casting rolls 120. In order to prevent the edge dams 140 from being pushed backward by the pressure of melt 122, hydraulic devices (not illustrated) support the back faces of the edge dams 140.

The edge dams 140 which prevent the spilling of the melt 122 are subjected to wear due to the frictions between the edge dams 140 and the revolving rolls 120. When the casting operation is carried out for a long time, the casting stability is aggravated due to an excessive wear of the edge dams 140. Therefore it is a necessity to reduce the wear rate so as to extend the life expectancy of the casting machine.

Further, the casting rolls 120 are also subjected to wear due to the frictions with the edge dams 140, with the result that the friction faces 125 of the casting rolls 120 are damaged. Such a damage of the casting rolls 120 accelerates the wearing of the refractory material 142 of the edge dams 140. Therefore, the friction faces 125 of the casting rolls 120 need to be protected from wear.

The edge dam 140 is made of a refractory base material which has a high thermal shock resistance, a superior high temperature strength, and a low thermal deformation, such as mullite, fused silica, silicon carbide or the like. In addition, the friction face of the edge dam 140 is added with a ceramic layer 142 which has a high thermal shock resistance, a high corrosion resistance (against the melt), a high toughness, a good machinability and the like, such as $Si_3N_4$-BN composite, AlN-BN composite, SiC-BN composite or the like (refer to FIG. 2). The ceramic layer 142 undergoes wear because it is closely contacted to the fast revolving casting rolls with a pressure of 2–4 $Kg/cm^2$.

Generally, in the case where the composite material of the ceramic layer 142 is made to contain 40–60 vol % of BN, the wear rate is about 0.5 mm/min.

Therefore, if the casting operation is carried out for a long time, the wear becomes excessive, with the result that the casting stability is aggravated, and that the durability and life expectancy of the edge dam 140 are shortened.

If the hardness of the ceramic material of the ceramic layer 142 is high, although the wear rate is decreased, the friction face 125 of the casting roll 120 is damaged, giving a severe problem.

In this manner, there occur serious frictions between the ceramic layer 142 and the friction face 125 of the side of the casting rolls 120. If the hardness or the wear resistance of the ceramic layer 142 is higher than that of the friction face 125 of the casting roll 120, the wear of the edge dam 140 is small, but the wear of the friction face 125 of the casting roll 120 becomes high. In a worse case, pockmarks are formed on the casting rolls 120, with the result that the edge portions of the manufactured strips 130 become defective, and that the melt is spilled from between the casting rolls 120, these being a serious problem.

Therefore, Japanese Patent Gazette No. Hei-7-68352 proposes the following method. That is, a boron nitride composite ceramic layer which has a lubricating property and a proper wear resistance is attached on the portion of the edge dam 140 where frictions occur by being contacted with the casting roll 140. In this manner, the ceramic layer 142 of the edge dam 140, which has a low wear resistance in the relative terms, is made to be worn, thereby protecting the friction face 125 of the casting roll 120, and preventing the spilling of the melt.

However, the edge dams 140 are supported continuously by means of springs or hydraulic cylinders (not illustrated) to make the edge dams 140 closely contact with the casting rolls 120, and therefore, the wear of the ceramic layer 142 is increased too much after the elapse of casting time. Therefore, in the long run, the durability is aggravated owing to the increased wear.

Meanwhile, U.S. Pat. No. 5,201,362 discloses the following apparatus. That is, the closely contacting pressure of the edge dams 140 is controlled to a high level during the early casting stage, so that the wear of the ceramic layer 142 would be high in the early stage. However, when the casting is stabilized, the contacting pressure of the edge dams is lowered, and the contact force is controlled such that the wear rate should come into a proper range, thereby lowering the wear rate. In this method, after carrying out the casting for a long time, if the roughness of the friction face 125 of the casting rolls 120 becomes coarse, and if the physical properties of the ceramic material of the ceramic layer 142 are degraded at the high temperature, then the contacting pressure is lowered to obtain a decreased wear rate. In this manner, during the casting operation, an external force makes the edge dams 140 withdraw, and this withdrawing frequency is gradually increased. As a result, the quality of the edge portions of the metal strip 130 is degraded.

Meanwhile, in an attempt to overcome the damage of the casting rolls 120 and the excessive wear of the edge dams 140, Japanese Patent Laid-open No. Hei-9-108788 discloses the following apparatus. That is, a solid lubricant such as sintered boron nitride (BN) which is manufactured by a hot pressing process is contacted to the friction face 125 of the casting roll 120 so as for the solid lubricant to be clad on the friction face 125. The lubricant cladding layer acts as a lubricant on the friction face 125, thereby preventing the wear of the casting rolls 120 and the edge dams 140. However, if the surface of the friction face 125 is smooth (and not coarse), then the solid lubricant layer is hardly formed. On the other hand, if the surface of the friction face 125 is coarse, then the lubricant layer becomes too thick or the lubricating effect is decreased. Consequently, depending on the conditions of the surface of the friction face 125, either the lubricant layer is not formed, or a non-uniform lubricant layer is formed, this being a problem.

SUMMARY OF THE INVENTION

The present invention is intended to overcome the above described disadvantages of the conventional techniques.

Therefore it is an object of the present invention to provide an apparatus and a method for lubricating edge dams of a twin-roll type strip casting machine, in which the casting rolls and the edge dams are protected from being wear-damaged, thereby improving the durability and life expectancy of the casting machine.

In achieving the above object, the apparatus for lubricating edge dams in a twin-roll type strip casting machine for reducing wear between the edge dams and casting rolls according to the present invention includes: a lubricant spouting nozzle disposed adjacently to a friction face of the casting roll; a lubricant supplying device for supplying a lubricant to the lubricant spouting nozzle so as to make the lubricant spouted and adhered on the friction face of the casting roll; and a lubricant spreading roller installed at the rear of the lubricant spouting nozzle, for pressing the lubricant onto the friction face of the casting roll with a certain pressure so as to make the lubricant clad on the friction face.

In another aspect of the present invention, the method for lubricating edge dams in a twin-roll type strip casting machine for reducing wear between the edge dams and casting rolls according to the present invention includes the steps of: spouting a liquid lubricant (a mixture of lubricant particles and a solvent) onto a friction face of the casting rolls; pressing and cladding the lubricant to make the lubricant uniformly spread on the friction face with a certain width; and forming a lubricating layer continuously on the friction face in a state with a solvent of the liquid lubricant being evaporated.

BRIEF DESCRIPTION OF THE DRAWINGS

The above object and other advantages of the present invention will become more apparent by describing in detail the preferred embodiment of the present invention with reference to the attached drawings in which:

FIG. 5 illustrates the state of spreading the lubricant on the casting rolls by the edge dam lubricating apparatus of the present invention in a stepwise form, in which:

DETAILED DESCRIPTION OF THE INVENTION

In the apparatus for lubricating the edge dams of the twin-roll type strip casting machine according to the present invention, a lubricating boundary layer is continuously formed between a friction ceramic material 142 of an edge dam and a friction face 125 of a casting roll 120. In this manner, the wear of the friction ceramic material 142 is lowered, and the casting rolls are prevented from being damaged.

Figure 1:
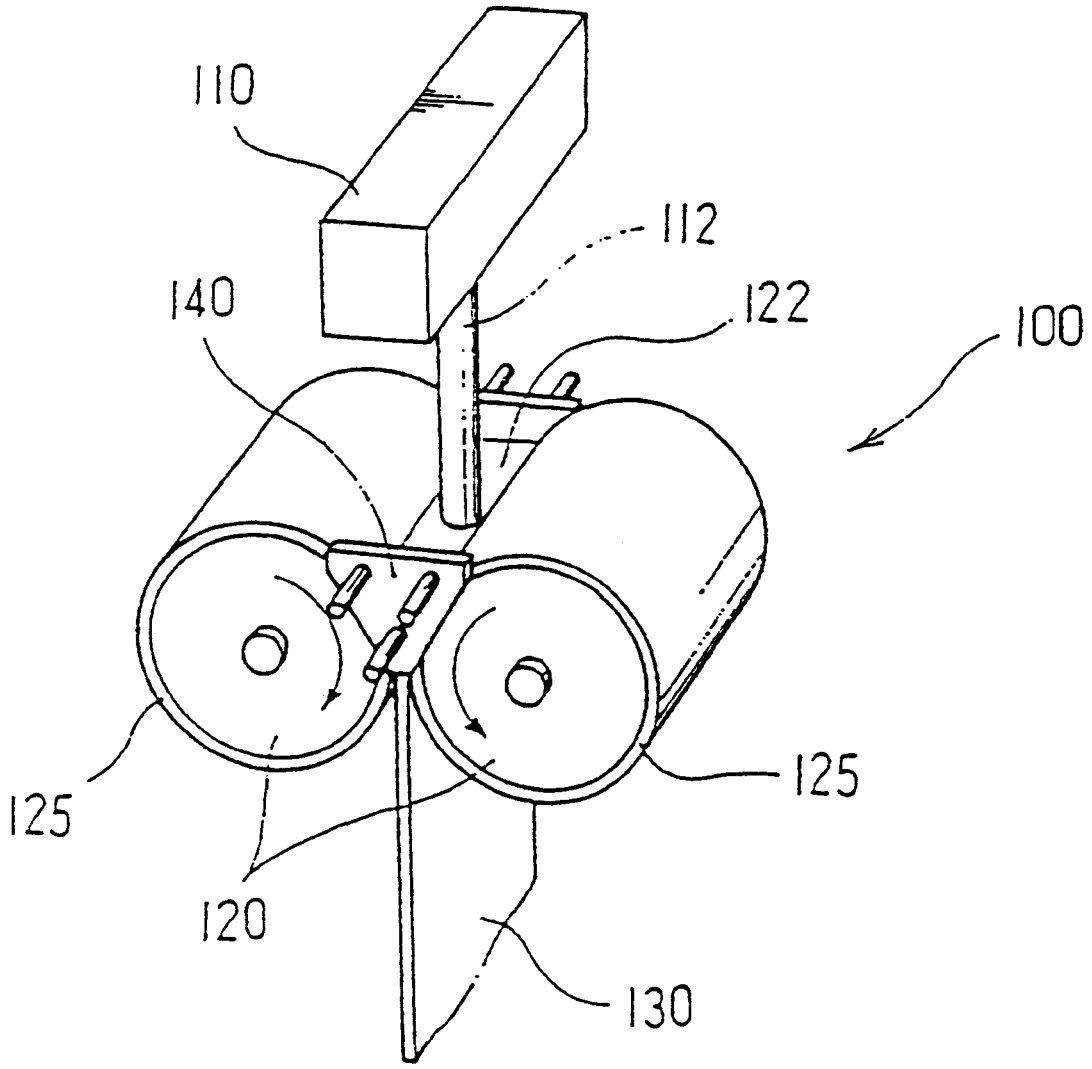
FIG. 1 is a perspective view of the general twin-roll type strip casting machine.
Figure 2:
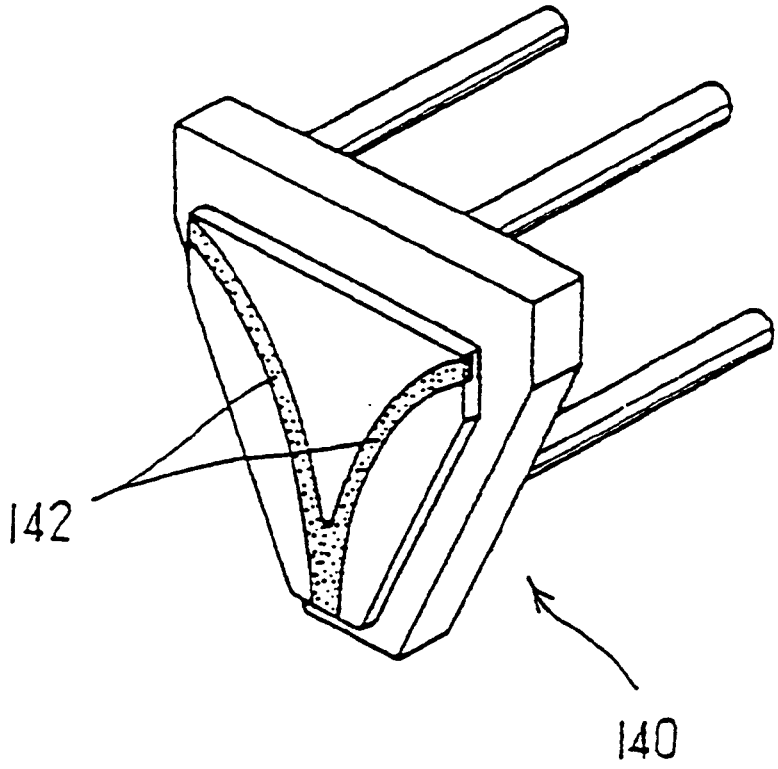
FIG. 2 is a perspective view of the edge dam used in the general twin-roll type strip casting machine.
Figure 3:
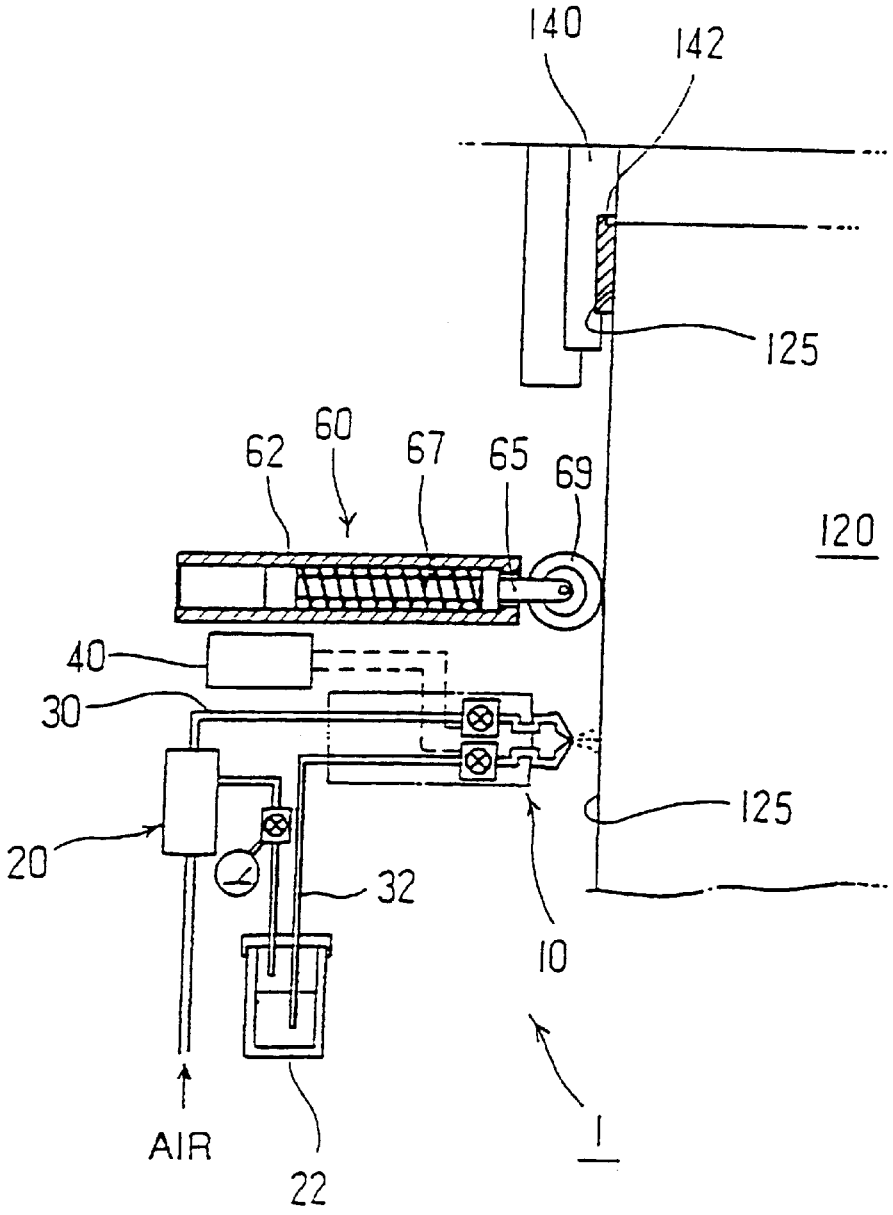
FIG. 3 illustrates the edge dam lubricating apparatus of the present invention, the apparatus being installed on the twin-roll type strip casting machine.
Figure 4:
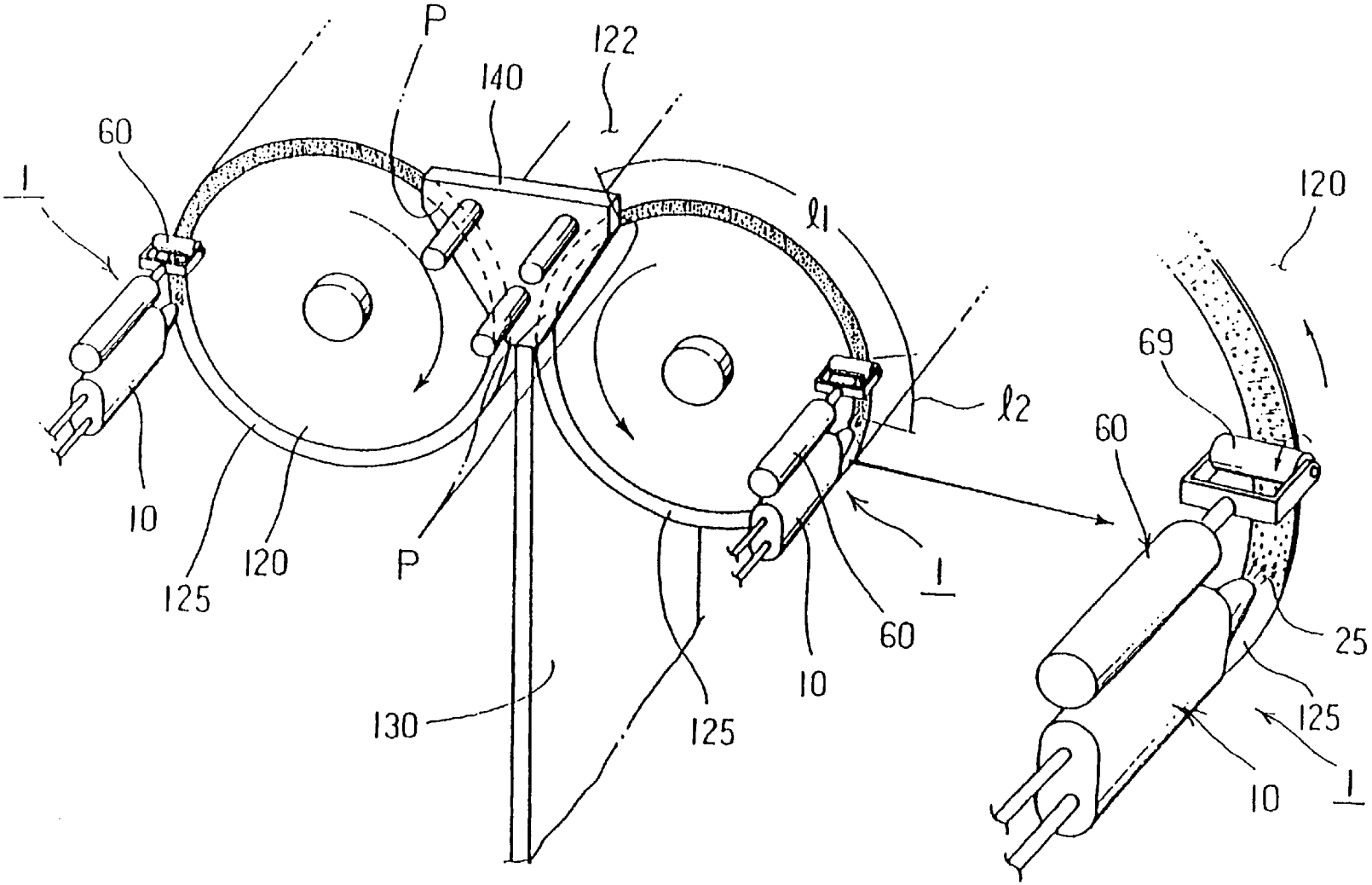
FIG. 4 illustrates the operation of the lubricating apparatus of the present invention, the apparatus being installed on a twin-roll type strip casting machine.
Figure 5A:
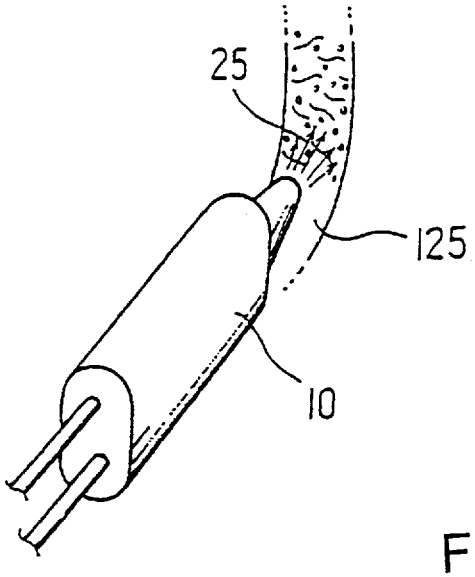
FIG. 5*a* illustrates the spouting of the lubricant.
Figure 5B:
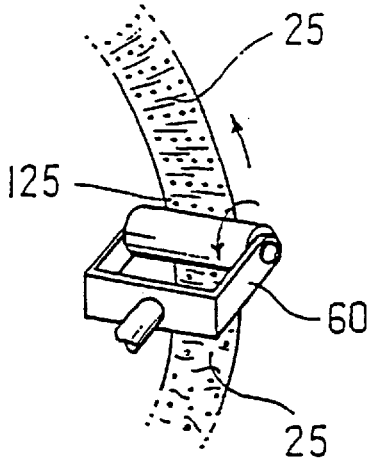
FIG. 5*b* illustrates the spreading of the lubricant.
Figure 5C:
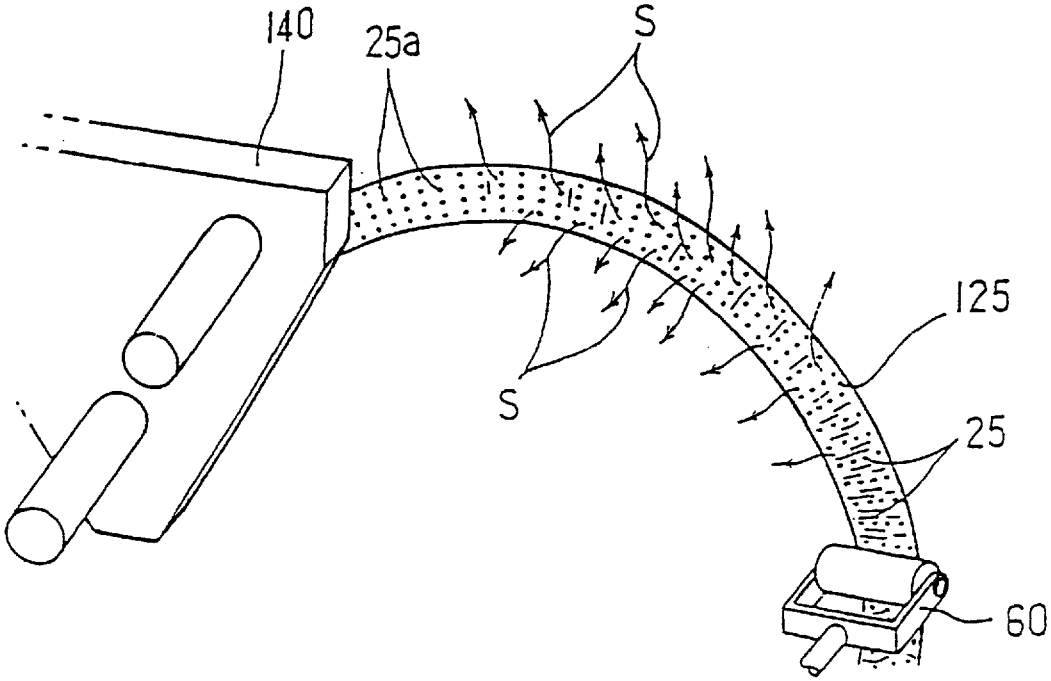
FIG. 5*c* illustrates the adhering of the lubricant particles on the casting rolls while the solvent is being evaporated.

As shown in FIGS. 3 and 4, an edge dam lubricating apparatus 1 for the twin-roll type strip casting machine is disposed at a side of the casting rolls 120. That is, the edge dam lubricating apparatus 1 is disposed upstream of a position P at which the casting roll contacts with the edge dam 140. The apparatus 1 includes a lubricant spouting nozzle 10 which is disposed adjacently to the friction face 125 of the casting roll 120 which in turn is secured to a shaft. The spouting nozzle 10 has a spout hole 12 with an inner diameter of 0.1–0.5 mm, and spouts proper amounts of a liquid lubricant onto the side friction face 125 of the casting roll 120 through air pressure.

Figure 6:
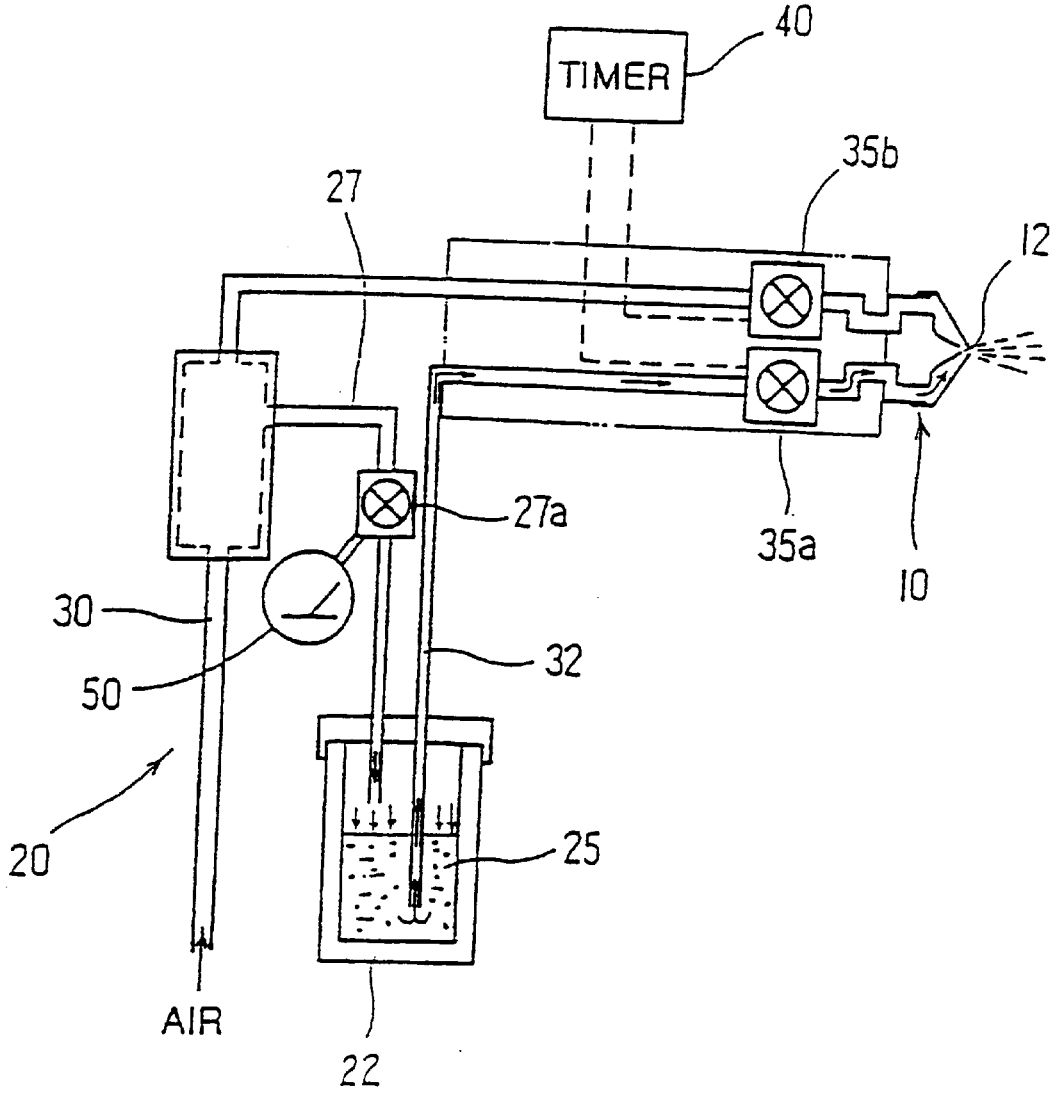
FIG. 6 illustrates the constitution of the lubricant supplying device installed on the edge dam lubricating apparatus of the present invention.

The lubricant spouting nozzle 10 is provided with a lubricant supplying device 20 for supplying the lubricant to the spouting nozzle 10. As shown in FIG. 6, the lubricant supplying device 20 includes a lubricant vessel 22 which contains a lubricant 25. In the lubricant 25, high temperature lubricant particles are dispersed within an easily evaporating solvent. An air pipe 27 passes through a lid of the lubricant vessel 22 after passing through a compressed air adjusting valve 27*a,* for supplying compressed air.

The upper tip of the air pipe 27 is connected to a side of a compressed air supplying tube 30, while the low tip of the air pipe 27 is suspended above the lubricant level surface within the lubricant vessel 22. Thus compressed air is supplied from the compressed air tube 30 into the vessel 22.

Further, a lubricant supply pipe 32 passes through the lid of the vessel 22, and the lower tip of the pipe 32 is dipped into the lubricant 25 within the vessel 22, while the upper tip of the pipe 32 is connected through a solenoid valve 35*a* to the spouting nozzle 10.

Thus when the edge dam 140 needs to be lubricated, the compressed air which has been adjusted by the compressed air flow rate adjusting valve 27*a* is supplied into the lubricant vessel 22. In this manner, if a certain level of pressure is established within the vessel 22, the lubricant is pushed out of the vessel 22 through the lubricant supplying pipe 32 to the spouting nozzle 10 owing to the increased air pressure within the vessel 22. The solenoid valve 35*a* is connected to a timer 40 which is turned on/off at certain periods. Therefore, the lubricant supplying pipe 32 is opened/closed at certain periods, thereby controlling the supply of the lubricant.

Meanwhile, during the time when the solenoid valve 35*a* closes the lubricant supplying pipe 32, the solvent of the residual lubricant 25 within the nozzle 10 is dried away, and therefore, the lubricant particles are condensed. Therefore, a spouting hole 12 of the spouting nozzle 10 is likely to be clogged. In this case, the lubricant 25 cannot be supplied to the friction face 125 of the casting roll 120, or the supply is reduced, thereby impairing the lubrication of the friction face 125.

In order to prevent this phenomenon, during the time when the lubricant 25 is not being supplied to the nozzle 10, the compressed air is permitted to flow through the spouting nozzle 10. That is, separately from the lubricant supplying pipe 32, the compressed air supplying tube 30 is connected to the spouting nozzle 10, and a solenoid valve 35*b* is installed between the tube 30 and the nozzle 10. The solenoid valve 35*a* and the solenoid valve 35*b* are alternately oppositely turned on/off by the same timer 40. That is, when the timer 40 is turned on, the tube 30 is closed by the solenoid valve 35*b,* and only the lubricant 25 is supplied to the nozzle 10 to spout the lubricant to the friction face 125 of the casting roll 120.

On the other hand, when the timer 40 is turned off, the lubricant supplying pipe 32 is closed, and only the compressed air supplying tube 30 is opened, so that the compressed air would flow through the nozzle 10 to discharge the residual lubricant 25. Accordingly, the spouting hole 12 of the nozzle 10 is never clogged.

The lubricant supply period is controlled by closing/opening the lubricant supplying pipe 32 by the solenoid valve 35*a*. The lubricant supply rate is measured by a compressed air pressure gage 50, and is controlled by the lubricant flow rate adjusting valve 27*a*.

Further, there is provided a lubricant spreading roller 60 installed downstream of the nozzle 10 to press the lubricant to the friction face 125 with a certain pressure so as to spread the lubricant to the friction face 125. The lubricant spreading roller 60 is made of a metal or a heat resistant material, and has a sufficient width, for uniformly spreading the lubricant to the friction face 125. The roller 60 is constituted as follows. That is, a supporting rod 65 is installed within a guide tube 62, and the rear end of the rod 65 is supported by a spring 67. A roller member 69 is rotatably installed at the leading end of the supporting rod 65, and thus, the roller member 69 closely contacts with the friction face 125 owing to the elastic force of the spring 67.

The spreading roller 60 is installed at a distance of 30–70 mm from the rear of the nozzle 10, so that the lubricant 25 can be uniformly spread on the side face of the casting roll 120 before the complete evaporation of the lubricant. Further, the spreading roller 60 is installed at a distance of 500–1000 mm in front of a contact point P between the edge dam 140 and the casting roll 120, so that the solvent of the lubricant would be completely evaporated before the contact of the lubricant to the edge dam 140, and that only the lubricant particles would remain on the friction face 125 of the casting roll 120.

In the edge dam lubricating apparatus for the twin-roll type strip casting machine, a uniform lubricant layer is continuously supplied to the ceramic material 142 of the friction face of the edge dam 140 and to the friction face 125 of the casting roll 120, so that the wear rate of the edge dam 140 can be controlled, and that the damages to the products can be prevented. Particularly, the lubricant 25 in which the lubricant particles are dispersed is spouted to the friction face 125 and is dried, so that the a lubricant layer would be clad onto the friction face 125. In this manner, the lubricant layer is continuously supplied to the friction face 125 of the casting roll 120.

Thus the spouting nozzle 10 spouts the lubricant at proper periods and with a proper spouting rate. The spouted lubricant is not spread uniformly immediately, and therefore, the spreading roller 60 installed downstream spreads the spouted lubricant into a uniform lubricant layer.

The lubricant is carried toward the contact point P, and during this carriage, the solvent S is evaporated, and only the lubricant particles remain.

Figure 7:
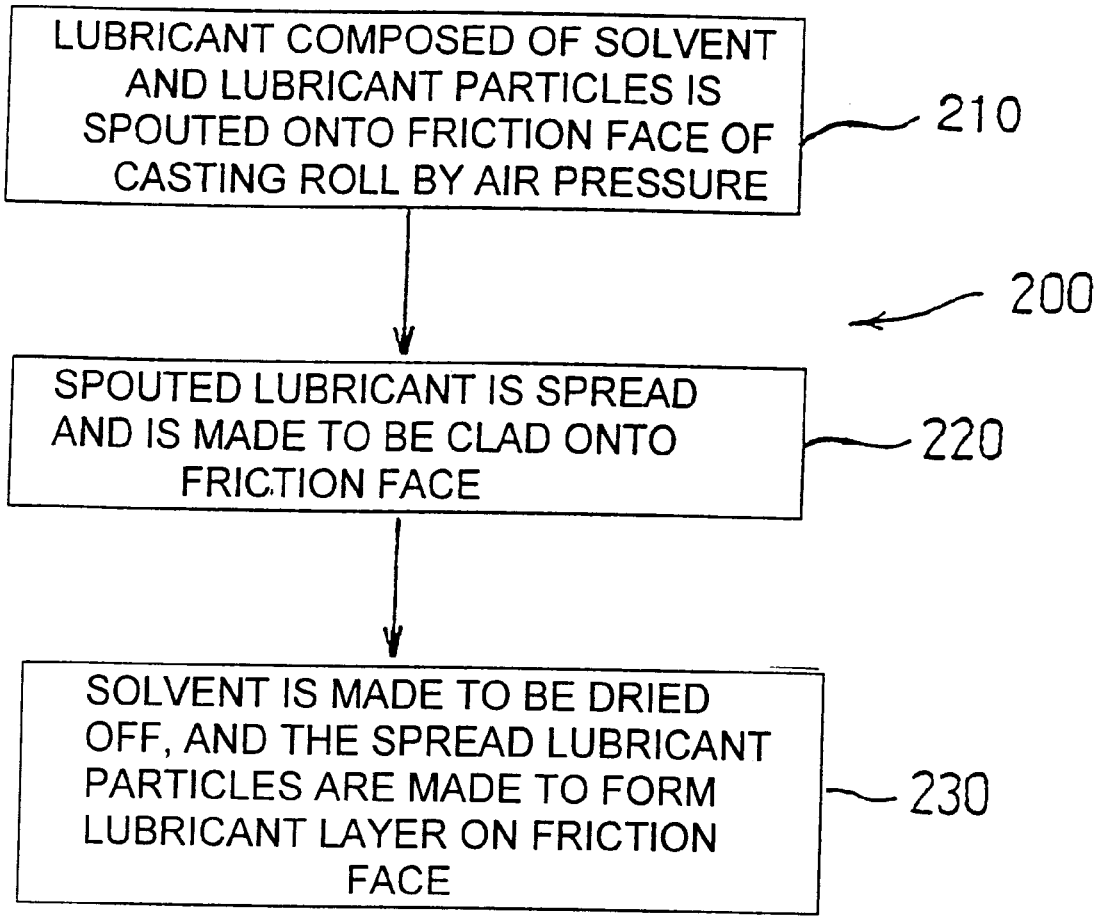
FIG. 7 is a flow chart showing the edge dam lubricating method according to the present invention.

Now the method 200 of lubricating the edge dam 140 will be described referring to FIG. 7. As shown in FIG. 7, first at a step 210, a liquid lubricant 25 which is mixture of a solvent S and lubricant particles 25*a* is spread onto the friction face 125 of the casting roll 120 by the air pressure. At the step 210, the lubricant particles have preferably planar crystals, and are preferably h-BN, $MoS_2$, graphite or the like, while the solvent S is an unflammable and rapid drying solvent preferably consisting of phosphoric ester, chlorohydrocarbon or the like. Further, the lubricant should preferably contain a binder, and the solid lubricant particles should preferably be contained in an amount of 5–20 wt %.

At a step 220, pressing and cladding are carried out so that the liquid lubricant 25 would be spread with an intended width on the friction surface 125 of the casting roll 120. The lubricant spreading roller 60 contacts with the friction face 125 at a pressure of 0.5–1 $Kgf/cm^2$ by the help of the elastic force of the spring 67, thereby cladding the lubricant onto the friction face 125.

At a step 230, the solvent S of the lubricant is evaporated at a high temperature, and the spread solid lubricant particles 25*a* continuously form a lubricant layer on the friction face 125 of the casting roll 120. As described before, the roller 60 is installed at a distance of 500–1000 mm from the contact point P between the edge dam 140 and the casting roll 120, and therefore, during 0.3 to 0.8 seconds over the distance of 500–1000 mm, only the lubricant particles 25*a* remain on the friction face 125 of the casting roll 120.

Figure 8:
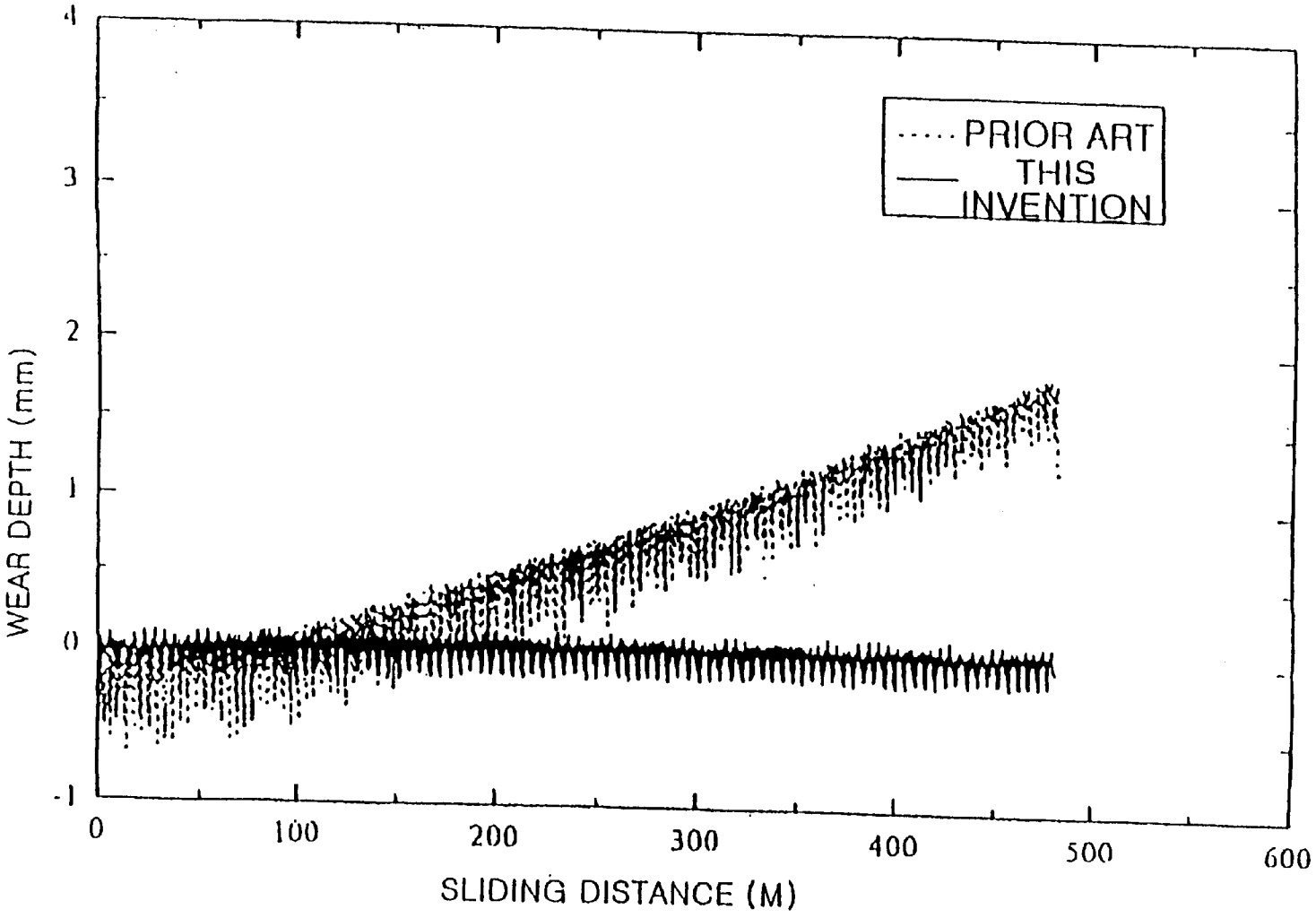
FIG. 8 is a graphical illustration showing the wear rate after applying the lubricating method of the present invention, and the wear rate before applying it.

In order to know the action and effects of the present invention, a series of experiments were carried out. By carrying out the experiments, the wear rate of the ceramic material 142 of the edge dam 140 could be measured, and this measured result together with the conventional wear rate is illustrated in FIG. 8.

<Example>

A twin-roll type strip casting machine having a capacity of 10 tons was used. In a comparative case, no lubricant was spread, while in the case of the present invention, the lubricant was spread on the friction face 125 of the casting roll 120. Then the two cases were compared with each other by continuously measuring the wear rate. The ceramic material 142 of the edge dam 140 was a hot press material containing about 50% of boron nitride (h-BN). The edge dam 140 was contacted with the side face of the casting roll 120 at a pressure of 3 $Kg/cm^2$.

The revolution speed of the casting roll 120 was 80 m/min in average, and 500 m of a metal strip 130 was continuously manufactured. During this time, a position sensor (not illustrated) was installed below the edge dam 140, and the wear rates were measured based on the position shift of the edge dam 140. In this way, the wear rates for the conventional case and the case of the present invention were compared.

In the case of the present invention, the lubricant was continually supplied in such a manner that the lubricant was supplied for 1 second, and a halting was carried out for 0.5 seconds. The lubricant spreading roller 60 was installed at a distance of 800 mm in front of the contact point P between the friction face of the edge dam 140 and the friction face 125 of the casting roll 120. The lubricant spouting nozzle 10 was installed at a distance of 30 mm in front of the roller 60. The lubricant 25 was spouted through the nozzle 10 having an inside diameter of 0.2 mm with an air pressure of 1.5 $Kg/cm^2$, and diameter of the spouting stream of the lubricant was about 20 mm. The lubricant was made not to be scattered to the surface of roll barrel.

Meanwhile, the lubricant was a liquid lubricant which was composed of a chlorohydrocarbon solvent, 10 wt % of boron nitride powder, and 1 vol % or less of polyethyleneimine as a binder.

The wear rates for the conventional case and the case of the present invention were measured based on the position shifts of the edge dams 140, and the measured results are shown in FIG. 8. In the conventional case, the wear of the edge dam 140 was progressed constantly, and the average wear rate was about $3.24\times10^{-3}$ mm/M.

However, in the case of the present invention, there was almost no wear at all during the time when 500 M of strip continuously manufactured. Further, there was no extrusion of the molten steel through between the casting roll 120 and the edge dam 140, but strips of a good quality were produced.

According to the present invention as described above, an edge dam lubricating apparatus is installed at a certain distance from the contact point P between the edge dam 140 and the casting roll 120. A lubricant is spouted onto the friction face 125 of the casting roll 120, the lubricant being composed such that high temperature lubricant particles 25*a* are suspended within a solvent. Then a spreading roller 60 is made to spread the spouted lubricant uniformly on the friction face 125. In this manner, the solvent is evaporated at the high temperature, and only the lubricant particles 25*a* remain to form a lubricant layer. Accordingly, the wear of the edge dam 140 is decreased, and the life expectancy of the edge dam 140 is extended.

What is claimed is:

1. An apparatus for lubricating edge dams in a twin-roll type strip casting machine for reducing wear between said edge dams and casting rolls, comprising:

a lubricant spouting nozzle disposed adjacently to a friction face of said casting roll;

a lubricant supplying device for supplying a lubricant to said lubricant spouting nozzle so as to make the lubricant spouted and adhered on said friction face of said casting roll; and a lubricant spreading roller installed at a rear of said lubricant spouting nozzle, for pressing the lubricant onto said friction face of said casting roll with a certain pressure so as to make the lubricant clad on said friction face.

2. The apparatus as claimed in claim 1, wherein said lubricant supplying device comprises:

a lubricant containing vessel;

an air pipe passing through a compressed air flow rate adjusting valve and through a lid of said lubricant containing vessel, for supplying compressed air into said vessel;

a lubricant supplying pipe for supplying the lubricant to said nozzle; and a compressed air supplying tube for supplying compressed air into said nozzle.

3. The apparatus as claimed in claim 2, wherein said lubricant supplying device further comprises:

a first solenoid valve installed between said lubricant supplying pipe and said lubricant spouting nozzle;

a second solenoid valve installed between said compressed air supplying tube and said lubricant spouting nozzle; and a timer connected to said first and second solenoid valves, whereby if said timer is turned on, said compressed air supplying tube is closed by said second solenoid valve, and only said lubricant supplying pipe is opened, to supply the lubricant to said lubricant spouting nozzle so as to spout the lubricant to said friction face of said casting roll; and if said timer is turned off, said lubricant supplying pipe is closed, and only said compressed air supplying tube is opened to make compressed air flow through said lubricant spouting nozzle so as to discharge a residual lubricant from said lubricant spouting nozzle.

4. The apparatus as claimed in claim 1, wherein said lubricant spreading roller comprises:

a roller member made of a metal or heat resistant material having a proper width to uniformly spread the lubricant onto said friction face of said casting roll;

a supporting rod accommodated within a cylindrical guide tube, with a rear end of said rod being supported by a spring; and said roller member being rotatably secured to a leading end of said rod, to make said roller member closely contacted to said friction face of said casting roll by an elastic force of said spring.

5. The apparatus as claimed in claim 4, wherein said lubricant spreading roller is installed at a distance of 30–70 mm at a rear of said spouting nozzle to spread the lubricant on said friction face of said casting roll before a complete drying of the lubricant; and said lubricant spreading roller is installed at distance of 500–1000 mm in front of a contact point between said edge dam and said casting roll, a solvent of the lubricant being dried off before arrival of said lubricant to said edge dam, and only lubricant particles remaining.

6. A method for lubricating edge dams in a twin-roll type strip casting machine for reducing wear between said edge dams and casting rolls, comprising the steps of:

spouting a liquid lubricant having a mixture of lubricant particles and a solvent onto a friction face of said casting roll;

pressing and cladding the lubricant to make the lubricant uniformly spread on said friction face with a required width; and forming a lubricating layer continuously on said friction face, in a state with a solvent of the liquid lubricant being evaporated.

7. The method as claimed in claim 6, wherein the liquid lubricant is composed of: high temperature lubricant particles having planar crystals selected from the group consisting of h-BN, $MoS_2$, and graphite; an uninflammable and rapid drying solvent selected from the group consisting of phosphoric ester, and chlorohydrocarbon; a binder, said particles being uniformly dispersed within said solvent.

8. The method as claimed in claim 7, wherein the liquid lubricant contains 5–20 wt % of solid phase lubricant particles.

9. The method as claimed in claim 6, wherein the liquid lubricant is spread on said friction face of said casting roll at a pressure of 0.5–1 $Kgf/cm^2$ by a lubricant spreading roller.

* * * * *